US005876289A

United States Patent [19]

Liu

[11] Patent Number: 5,876,289

[45] Date of Patent: Mar. 2, 1999

[54] SAFETY SWING SEAT MOUNTING STRUCTURE

[76] Inventor: Lausan Chung Hsin Liu, No. 243, Chien-Kuo Rd., Hsin-Tien City, Taipei Hsien, Taiwan

[21] Appl. No.: 108,778

[22] Filed: Jul. 2, 1998

[51] Int. Cl.[6] ..... A63G 9/12

[52] U.S. Cl. ..... 472/118; 472/125; 403/116

[58] Field of Search ..... 472/118, 119, 472/120, 121, 122, 123, 124, 125; 297/273; 403/116, 113, 112

[56] References Cited

U.S. PATENT DOCUMENTS

| | | | |
|---|---|---|---|
| 3,503,582 | 3/1970 | Boucher | 472/118 |
| 4,018,538 | 4/1977 | Smyrni et al. | 403/346 |
| 4,911,429 | 3/1990 | Ogbu | 472/118 |
| 5,147,247 | 9/1992 | Addleman | 472/118 |
| 5,154,672 | 10/1992 | Brown | 472/118 |

*Primary Examiner*—Kien T. Nguyen
*Attorney, Agent, or Firm*—Bacon & Thomas, PLLC

[57] ABSTRACT

A safety swing seat mounting structure includes a coupling mechanism mounted between a support frame and a swing seat, enabling the swing seat to be swung on the support frame, the coupling mechanism including a pivot pin mounted on the support frame and a coupling plate mounted on the swing seat and turned with the swing seat about the pivot pin, and a constraint mechanism which limits the swinging angle of the swing seat, the constraint mechanism including a transversely extended oblong constraint hole provided at the coupling plate, and a constraint rod fixedly mounted on the support frame and hooked in the constraint hole.

4 Claims, 5 Drawing Sheets

SAFETY SWING SEAT MOUNTING STRUCTURE

BACKGROUND OF THE INVENTION

The present invention relates to a swing, and more specifically to a safety swing seat mounting structure used in a swing to coupling a swing seat to a support frame, enabling the swing seat to be swung on the support frame within a limited angle.

A regular swing, as shown in FIG. 1, is generally comprised of a support frame, a swing seat, and two coupling devices bilaterally coupled between the support frame and the swing seat, enabling the swing seat to be swung on the support frame. This structure of swing is functional, however it is not safe in use. Because this structure of swing has no means to limit the swinging angle of the swing seat, the child may fall from the swing seat when the swing seat is moved from a horizontal position to a substantially vertical position. Furthermore, the swing seat of this structure of swing cannot be firmly maintained in position when a child sits on it.

SUMMARY OF THE INVENTION

The present invention has been accomplished to provide a safety swing seat mounting structure which eliminates the aforesaid problems. It is one object of the present invention to provide a safety swing seat mounting structure which limits the swinging angle of the swing seat, enabling the swing to be played safely. It is another object of the present invention to provide a safety swing seat mounting structure which allows the user to lock the swing seat and to stop it from swinging. To achieve these and other objects of the present invention, there is provided a safety swing seat mounting structure comprised of a coupling mechanism, a constraint mechanism, and a locking mechanism, wherein the coupling mechanism is mounted between a support frame and a swing seat, enabling the swing seat to be swung on the support frame, the coupling mechanism comprising a pivot pin mounted on the support frame and a coupling plate mounted on the swing seat and turned with the swing seat about the pivot pin; the constraint mechanism which limits the swinging angle of the swing seat, comprising a transversely extended oblong constraint hole provided at the coupling plate, and a constraint rod fixedly mounted on the support frame and hooked in the constraint hole; the locking mechanism comprises a lock hole provided at the coupling plate, and a lock device mounted on the support frame and fastened to the lock hole to stop the coupling plate from swinging.

DETAILED DESCRIPTION OF THE PREFERRED EMBODIMENT

Figure 1:
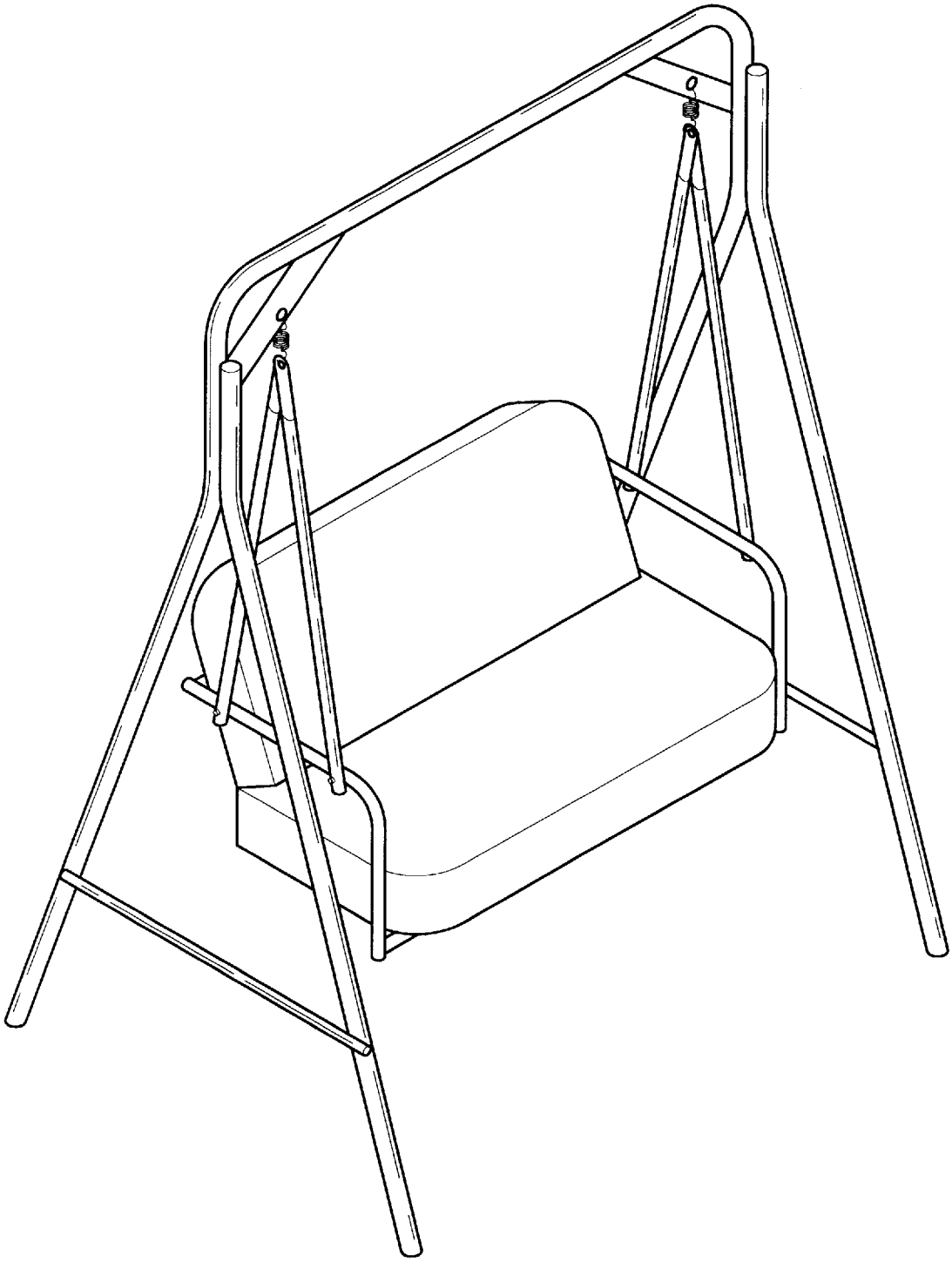
Fig. 1 PRIOR ART
FIG. 1 is an exploded view of a swing according to the prior art.
Figure 2:
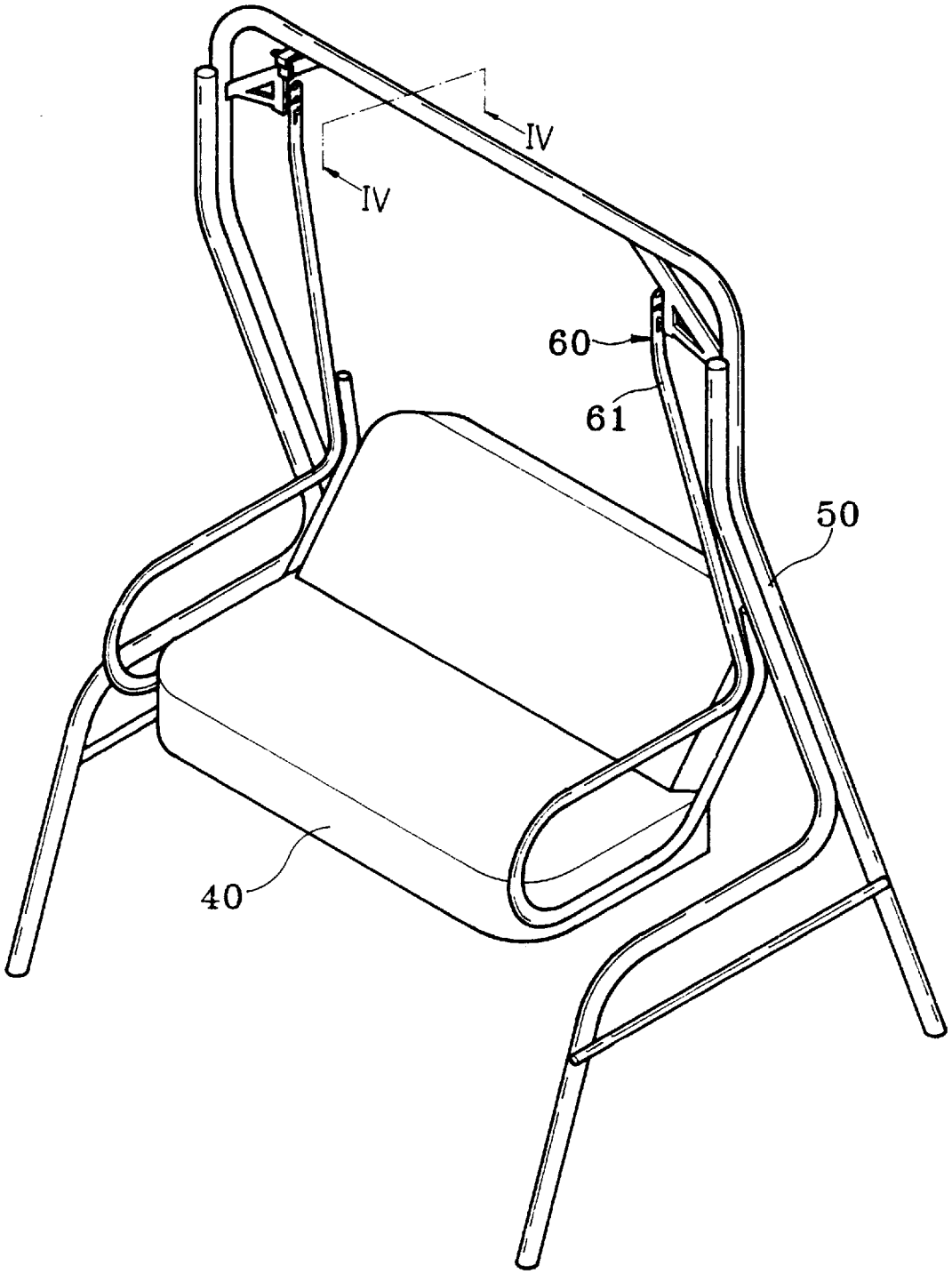
FIG. 2 is a perspective view of a swing constructed according to the present invention.
Figure 3:
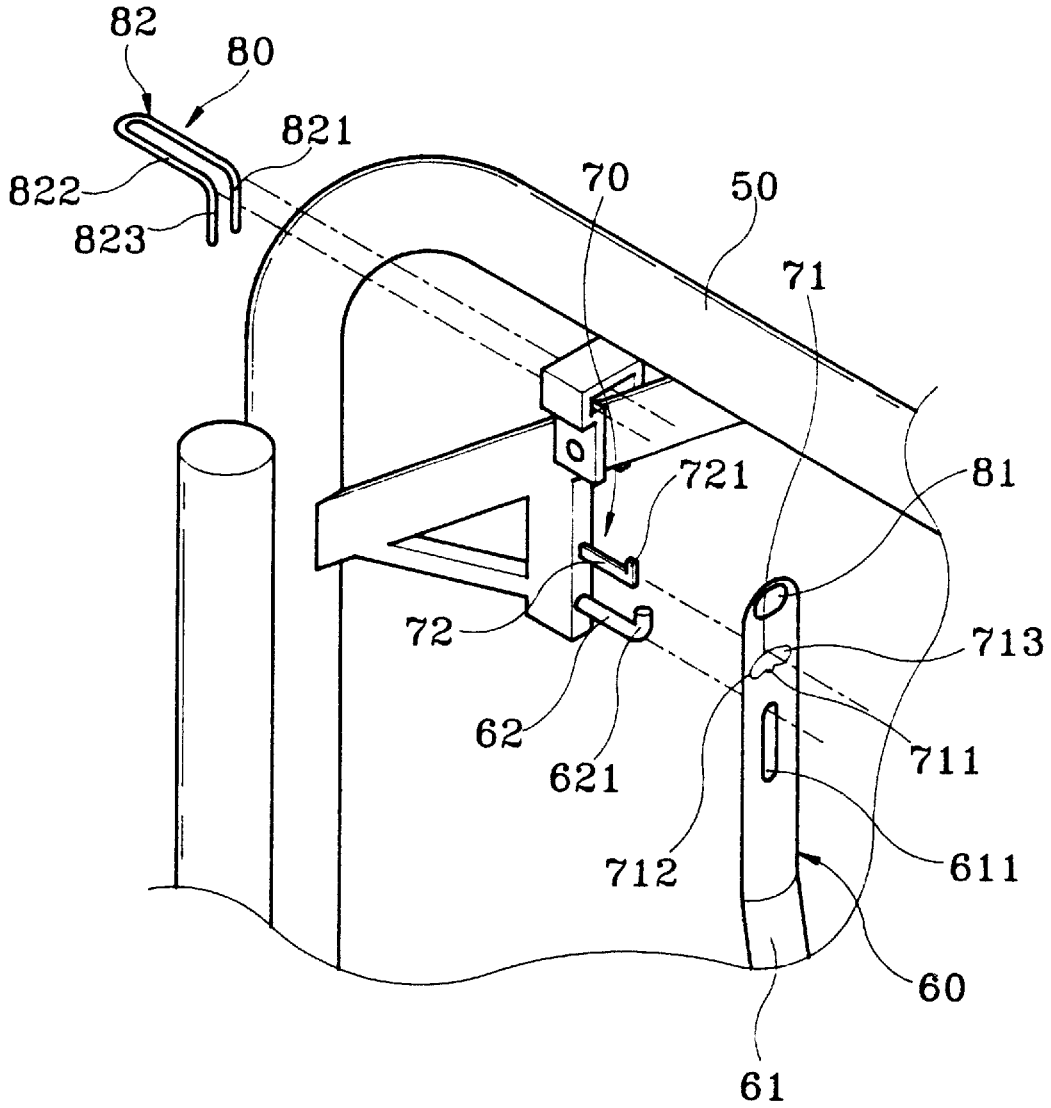
FIG. 3 is an exploded view of the safety swing seat mounting structure according to the present invention.
Figure 4:
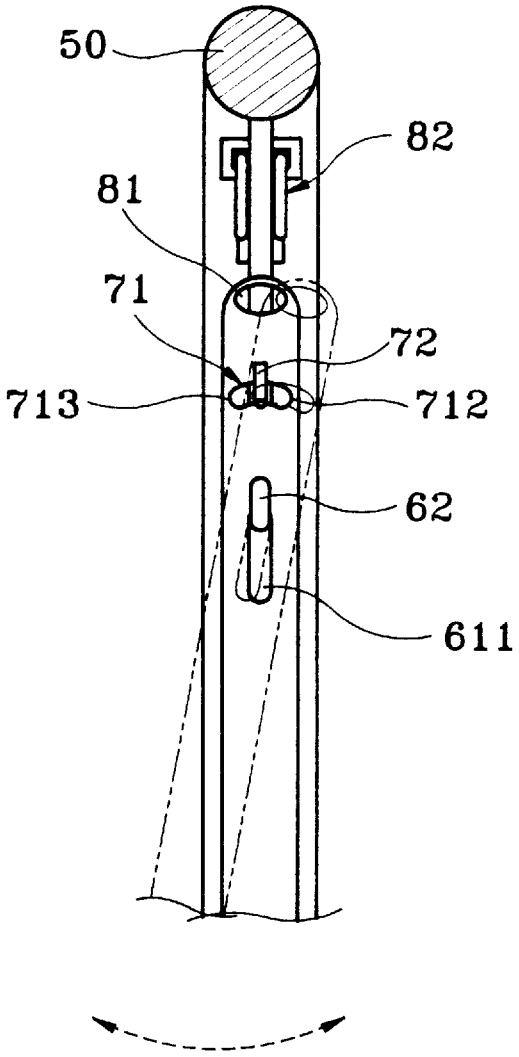
FIG. 4 is a side plain view taken along line IV—IV of FIG. 2, showing the coupling plate swung.

Referring to FIGS. 2, 3 and 4, a swing is shown comprised of a support frame 50, and a swing seat 40 hung on the support frame 50.

Two safety swing seat mounting structures are arranged bilaterally arranged between the support frame 50 and the swing seat 40, enabling the swing seat 40 to be coupled to and swung from the support frame 50. Each safety swing seat mounting structure is comprised of a coupling mechanism 60, a constraint mechanism 70, and a locking mechanism 80.

The coupling mechanism 60 enables the swing seat 40 and the support frame 50 to be pivoted together, and is comprised of a coupling plate 61 fixedly connected to one lateral side of the swing seat 40, and a pivot pin 62 fixedly horizontally mounted on the support frame 50 at one lateral side near the top. The coupling plate 61 has a longitudinally extended elongated hole 611. The pivot pin 62 has a hooked end 621 turned upwards. When the pivot pin 62 is inserted through the elongated hole 611 on the coupling plate 61, the hooked end 621 of the pivot pin 62 is hooked on the coupling plate 61, and therefore the coupling plate 61 is hung on the pivot pin 62 and can be turned about pivot pin 62.

The constraint mechanism 70 limits the swinging angle of the swing seat 40 relative to the support frame 50, comprising a transversely extended oblong constraint hole 71 formed at the coupling plate 61 above the elongated hole 611, a notch 711 at the bottom side of the constraint hole 71 on the middle, and a constraint rod 72 fixedly horizontally mounted on the support frame 50 above the pivot pin 62 and coupled to the constraint hole 71. The constraint rod 72 has a hooked end 721 turned upwards. The notch 711 imparts a space, enabling the hooked end 721 of the constraint rod 72 to be inserted through the constraint hole 71 and then hooked on the coupling plate 61.

Because the constraint rod 72 is fixedly connected to the support frame 50 and hooked in the constraint hole 71 on the coupling plate 61, the swinging angle of the swing seat 40 is limited to a certain range when the swing seat 40 swings.

The locking mechanism 80 is to lock the swing seat 40, and to stop the swing seat 40 from swinging. The locking mechanism 80 comprises a lock hole 81 formed at the top end of the coupling plate 61 above the constraint hole 71, and a lock device 82 hung on the support frame 50 and inserted into the lock hole 81 to stop the coupling plate 61 from swinging. The lock device 82 is comprised of two L-shaped retainer rods 821 integral with each other and connected in parallel. The L-shaped retainer rods 821 each are comprised of a horizontal long rod section 822 and a vertical short rod section 823 integral with one end of the horizontal long rod section 822 at right angles. The horizontal long rod sections 822 of the L-shaped retainer rods 821 are connected together, and plugged into a hole on the support frame 50. The vertical short rod sections 823 of the L-shaped retainer rods 821 can be inserted into the lock hole 81 on the coupling plate 61 to stop the coupling plate 61 from swinging.

Referring to FIG. 4 again, when a child sits on the swing seat 40 and swings the swing seat 40, the swing seat 40 is moved back and forth within a limited angle. When the swing seat 40 is moved forwards to a certain angle, the front end 712 of the constraint hole 711 is stopped by the constraint rod 72. On the contrary, when the swing seat 40 is moved backwards to a certain angle, the rear end 713 of the constraint hole 711 is stopped by the constraint rod 72. Therefore, the swing seat 40 is moved back and forth safely within a limited angle.

Figure 5:
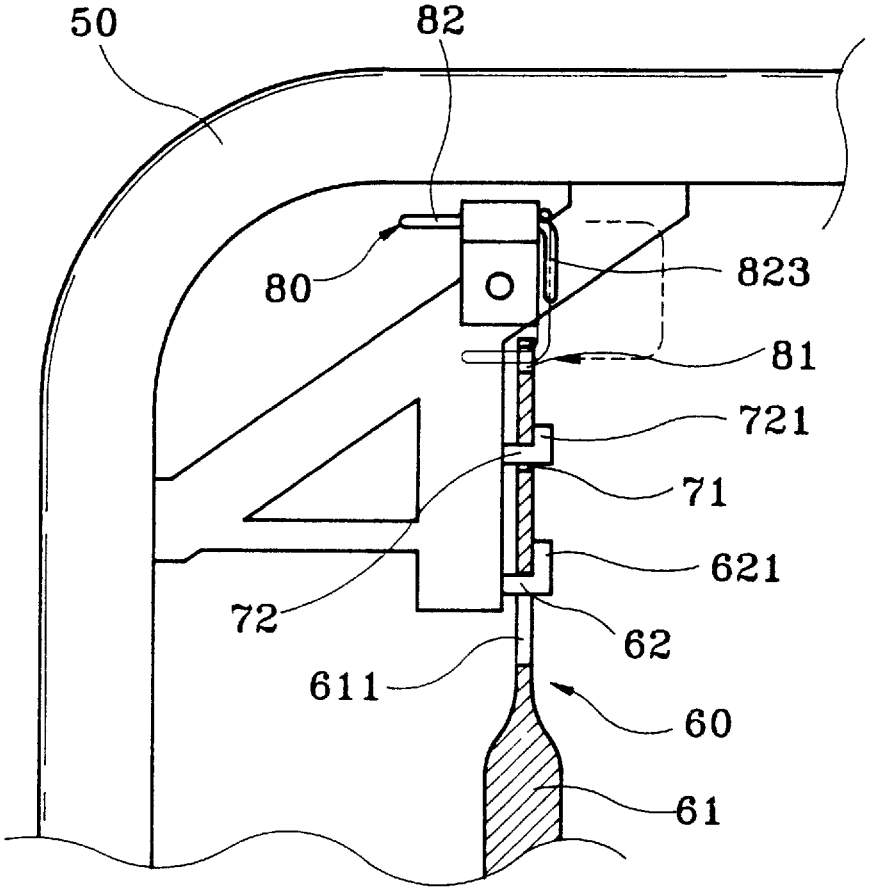
FIG. 5 shows the locking mechanism installed, the coupling plate locked according to the present invention.

Referring to FIG. 5 and FIG. 2 again, when the lock device 82 is plugged into a hole on the support frame 50 with the vertical short rod sections 823 of the L-shaped retainer rods 821 hooked in the lock hole 81 on the coupling plate 61, the coupling plate 61 is locked, and therefore the swing seat 40 is stopped from swinging.

While only one embodiment of the present invention has been shown and described, it will be understood that various modifications and changes could be made thereunto without departing from the spirit and scope of the invention disclosed.

What the invention claimed is:

1. A safety swing seat mounting structure used in a swing to coupling a swing seat to a support frame, enabling said swing seat to be swung on said support frame, the safety swing seat mounting structure comprising:

a coupling mechanism adapted to be mounted between said support frame and said swing seat, enabling said swing seat to be swung on said support frame, said coupling mechanism comprising a pivot pin adapted to be mounted on said support frame and a coupling plate adapted to be mounted on said swing seat and turned with said swing seat about said pivot pin; and a constraint mechanism which limits the swinging angle of said swing seat, said constraint mechanism comprising a transversely extended oblong constraint hole provided at said coupling plate, and a constraint rod adapted to be fixedly mounted on said support frame and hooked in said constraint hole.

2. The safety swing seat mounting structure of claim 1 further comprising a locking mechanism for locking said coupling plate to stop said swing seat from swinging, said locking mechanism comprising a lock hole provided at said coupling plate, and a lock device adapted to be mounted on said support frame and fastened to said lock hole.

3. The safety swing seat mounting structure of claim 2 wherein said lock device is comprised of two L-shaped retainer rods connected in parallel, said L-shaped retainer rods each comprised of a horizontal long rod section adapted to be fastened to said support frame and a vertical short rod section integral with one end of said horizontal long rod section at right angles and hooked in said lock hole.

4. The safety swing seat mounting structure of claim 1 wherein said constraint hole has a notch at a bottom side thereof on the middle through which said constraint rod is inserted and hooked on said coupling plate, and said constraint rod has a hooked end turned upwards and inserted through said notch and hooked on said coupling plate.

* * * * *